United States Patent [19]

Hardy

[11] Patent Number: 4,728,782

[45] Date of Patent: Mar. 1, 1988

[54] LOADING COMPENSATION IN CYCLOMETER REGISTER

[75] Inventor: Samuel G. Hardy, New Durham, N.H.

[73] Assignee: General Electric Company, Somersworth, N.H.

[21] Appl. No.: 36,317

[22] Filed: Apr. 9, 1987

[51] Int. Cl.[4] ..... G06C 15/26

[52] U.S. Cl. ..... 235/133 R; 235/1 C; 235/117 R

[58] Field of Search ..... 235/1 R, 1 C, 109, 110, 235/113, 116, 117 R, 94 R, 133 R

[56] References Cited

U.S. PATENT DOCUMENTS 3,116,875 1/1964 Wolfenden et al. ..... 235/117 R X
4,531,051 7/1985 Segmuller ..... 235/1 C

FOREIGN PATENT DOCUMENTS 985778 3/1965 United Kingdom .
1036601 7/1966 United Kingdom .

*Primary Examiner*—B. R. Fuller
*Attorney, Agent, or Firm*—Robert E. Brunson; Thomas R. Morrison

[57] ABSTRACT

A cyclometer register in an electric watthour meter includes a free counterweight for producing a kinetic-energy kick for advancing superior cyclometer drums. A drum counterweight, affixed to the units cyclometer drum, is disposed 180 angular degrees out of phase with the free counterweight. The drum counterweight has a moment equal to one-half the moment of the free counterweight, whereby the maximum sum of moments and the peak-to-peak moment is reduced by half. A harmonic counterweight rotates at twice the angular rate of the units cyclometer drum and reflects one-quarter of the moment of the free counterweight back to the driving elements. The harmonic counterweight reduces further the maximum moment as seen by the driving elements and also increases the minimum moment so that the variability in moment is reduced, thereby enabling an offsetting constant increase in meter torque and reducing metering error.

3 Claims, 6 Drawing Figures

LOADING COMPENSATION IN CYCLOMETER REGISTER

BACKGROUND OF THE INVENTION

The present invention relates to indicator devices and, more particularly, to cyclometer register devices of a type employing a plurality of cyclometer wheels concertedly driven to provide an indication of a quantity.

Cyclometer registers are commonly employed in, for example, watthour meters for indicating an amount of energy consumption. Conventionally, a lowest-order cyclometer drum, having numerals 0–9 on its edge, is driven by gearing from a meter disk which, in turn, is driven at a speed proportional to the instantaneous power usage. As the lowest-order drum passes through a transition from 9 to 0, it drives the next-higher order drum to advance through an angle corresponding to one digit on its edge. As this drum, in turn, passes through the transition from 9 to 0, it drives the next superior drum through an angle corresponding to a single digit on its edge.

A common problem with cyclometer registers arises from the numeric ambiguity during the time that a numeric transition is occurring in one or more of drums, and a 0–9 transition in one of the superior drums. In a slowly moving register, common in watthour meters, a superior drum may require a substantial time to achieve its transition as it is driven by the smoothly turning lowest-order drum. Cyclometer registers are used for the basic purpose of indicating discrete digits in response to an analog input. This is intended to avoid meter-reading errors common in dial-type registers. The slow transition of superior drums is contrary to the purpose of cyclometer registers since, during the transition, a meter reader may misread the indications of partly-rotated drums.

One solution to this problem disclosed, for example, in British Patents Nos. 985,778 and 1,036,601, employs an eccentric weight freely mounted on a common shaft with all of the drums and driven by the lowest-order drum. At a predetermined angular position of the lowest-order drum, usually at its 9–0 transition, the eccentric weight becomes overbalanced and rotates by gravity until it strikes an element connected to the next-higher-order drum. This rapidly flips the next-higher-order drum through it's next digit transition without the slownes inherent in an apparatus without a free eccentric weight. If the next-higher-order drum is also in a position requiring a 9–0 transition, then it, in turn drives its superior drum rapidly through a single-digit transition.

The driving torque for watthour meters is made purposely as low as possible to minimize the burden, or power, required to produce it. As a consequence, watthour meters are sensitive to elements in their registers requiring torque to overcome. Although torque requirements having a constant value such as, for example, frictional resistance, may be reasonably compensated by providing the meter with greater torque, when torque requirements vary from time to time to produce variations in meter speed, meter accuracy may be adversely affected. Raising the free eccentric weight from its lowest position to its overbalancing position increases the torque needed to drive a cyclometer register. Then, during the free fall of the free eccentric weight, and during an ensuing period before the task of raising it resumes, the required torque is lower. Such torque variations either require increasing the available torque from the watthour meter or, in an extreme case, may produce a periodic or an overall metering error. The lowest-order drum in the referenced British Patents include a counterweight substantially balancing the eccentric weight as it is raised from its equilibrium position. This counterweight must be elevated during the half cycle before contact is made with the eccentric weight, and thus contributes to unbalanced torque requirements.

OBJECTS AND SUMMARY OF THE INVENTION

It is an object of the invention to provide a cyclometer register which overcomes the drawbacks of the prior art.

It is a further object of the invention to provide a cyclometer register having a free eccentric weight for driving superior cyclometer drums wherein a peak torque requirement is reduced.

It is a further object of the invention to provide a cyclometer register having a free eccentric weight wherein a torque variability over a cycle of a lowest-order cyclometer drum is reduced.

Briefly stated, the present invention provides a cyclometer register in an electric watthour meter including a free counterweight for producing a kinetic-energy kick for advancing superior cyclometer drums. A drum counterweight, affixed to a units cyclometer drum, is disposed 180 angular degrees out of phase with the free counterweight. The drum counterweight has a moment equal to one-half the moment of the free counterweight, whereby the maximum sum of moments and the peak-to-peak moment is reduced by half. A harmonic counterweight rotates at twice the angular rate of the units cyclometer drum and reflects one-quarter of the moment of the free counterweight back to the driving elements. The harmonic counterweight reduces further the maximum moment as seen by the driving elements and also increases the minimum moment so that the variability in moment, and the torque required to overcome it, are reduced.

According to an embodiment of the invention, there is provided a cyclometer register comprising: a lowest-order cyclometer drum smoothly rotated at a speed proportional to a quantity to be measured, a free-counterweight disk freely disposed for rotation on a shaft concentric with the lowest-order cyclometer drum, the free-counterweight disk having a first predetermined rotational moment, at least one superior cyclometer drum, means for advancing the at least one superior cyclometer drum in response to a free rotation of the free-counterweight disk, cooperating means on the lowest-order cyclometer drum and the free-counterweight disk for rotating the free-counterweight disk from a stable equilibrium position to an overbalanced position from which it performs the free rotation, a drum counterweight on the lowest-order cyclometer drum, the drum counterweight being disposed to produce a second predetermined rotational moment, the second predetermined rotational moment being at an angular position on the lowest-order cyclometer drum 180 degrees apart from an angular position of the first predetermined moment while the lowest-order cyclometer drum is rotating the free-counterweight disk, and the second predetermined moment is equal to a predetermined fraction of the first predetermined moment, whereby a peak torque required to rotate the free-counterweight disk is reduced.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
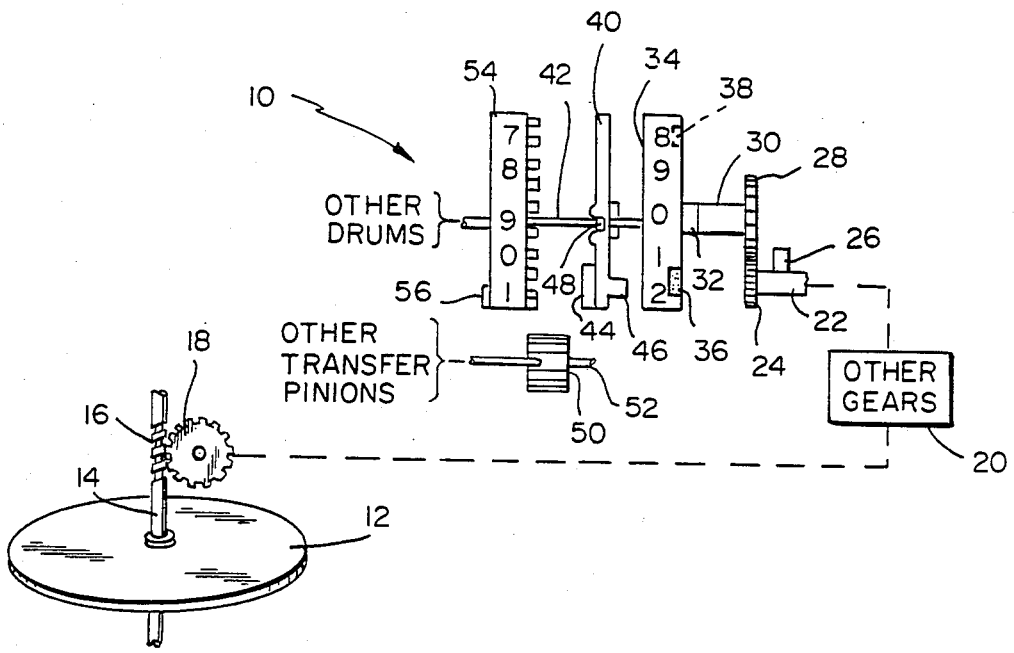
FIG. 1 a simplified schematic view of pertinent portions of a watthour meter including a cyclometer register according to an embodiment of the invention.

Referring to FIG. 1, there is shown, generally at 10, pertinent portions of a cyclometer register. A disk 12 of a watthour meter (not otherwise shown) is driven by interacting magnetic fluxes and eddy currents at a speed proportional to an instantaneous power consumption. A disk shaft 14, rotatably supported on bearings (not shown), includes a worm gear 16 integrally formed on a surface thereof. A worm wheel 18, engaging worm gear 16, is rotated at a speed related to the speed of disk 12.

The rotations of worm wheel 18 are transmitted through conventional other gears 20 to an intermediate shaft 22 rigidly affixed to an intermediate pinion 24. A harmonic mass 26 extends radially outward from intermediate shaft 22. The function of harmonic mass 26 will be explained hereinafter.

Intermediate pinion 24 is meshed with a final pinion 28 rigidly affixed to a final shaft 30. Final shaft 30, in turn, is connected for rotating a hub 32 of a units cyclometer drum 34. A drum counterweight 36 is disposed within units cyclometer drum 34 at a position placing it at the lower, or six-o'clock position, when the 0 of units cyclometer drum 34 is in the angular position shown. A driving boss 38 extends leftward within units cyclometer drum 34.

A free-counterweight disk 40 is disposed for free rotation on a shaft 42 extending axially from units cyclometer drum 34. A free counterweight 44 is affixed to one surface of free-counterweight disk 40. A driven boss 46 is disposed on the opposed surface of free-counterweight disk 40, generally centered angularly with driven boss 46 and positioned at a radius on free-counterweight disk 40 which generally equals the radial position of driving boss 38 in units cyclometer drum 34. When cyclometer register 10 is assembled, driven boss 46 extends within units cyclometer drum 34 wherein it interferes with driving boss 38 over a predetermined portion of the rotation of units cyclometer drum 34.

An indexing pocket 48 in an edge of free-counterweight disk 40 cooperates with a transfer pinion 50, freely rotatable on an idler shaft 52 for advancing a tens cyclometer drum 54 once per revolution of free-counterweight disk 40. In addition, tens cyclometer drum 54 includes an indexing pocket 56 for advancing a further superior cyclometer drum (not shown) through a further transfer pinion (not shown) on idler shaft 52. In this manner, any convenient number of cyclometer drums can be chained into a sequence with each superior drum advancing one digit per complete revolution of its next-inferior cyclometer drum. The technique for advancing tens cyclometer drum 54 one digit per revolution of free-counterweight disk 40 is conventional and would be fully understood by one skilled in the art. The same is true for other superior cyclometer drums. Further explanation thereof is thus omitted herefrom.

The provision of free-counterweight disk 40 and free counterweight 44 for providing a kinetic-energy kick to tens cyclometer drum 54, as well as other driving bosses 38 and driven bosses 46, are conventional. The following explanation is included as being necessary to an understanding of the invention.

For purposes of description, the angular position of units cyclometer drum 34 is considered to be zero degrees. The angular position advances with the visible surface of units cyclometer drum 34 rising while the angular position describes 360 degrees at which position it is returned to the zero-degree position illustrated.

In the prior art, the characteristics of drum counterweight 36 are unspecified and harmonic mass 26 is omitted.

Units cyclometer drum 34 is rotated from the zero-degree position shown to the 180-degree position at which position, driving boss 38 contacts driven boss 46. During that time, the torque required to rotate units cyclometer drum 34 is that necessary to overcome friction and to elevate drum counterweight to its uppermost position. Once the 180-degree position is passed, the torque for raising free-counterweight 44 is balanced by drum counterweight, whereby the required torque remains at a value required to overcome friction. At about 360 degrees, free counterweight 44 becomes overbalanced. Free-counterweight disk 40 then rotates freely, picking up rotational kinetic energy by the descent of free counterweight 44 until indexing pocket 48 engages a long tooth on transfer pinion 50, thereby indexing tens cyclometer drum 54 one digit forward. The kinetic energy of free-counterweight disk 40 ensures that the indexing takes place almost instantly, whereby partial slow indexing of tens cyclometer drum 54 is avoided.

Figure 2:
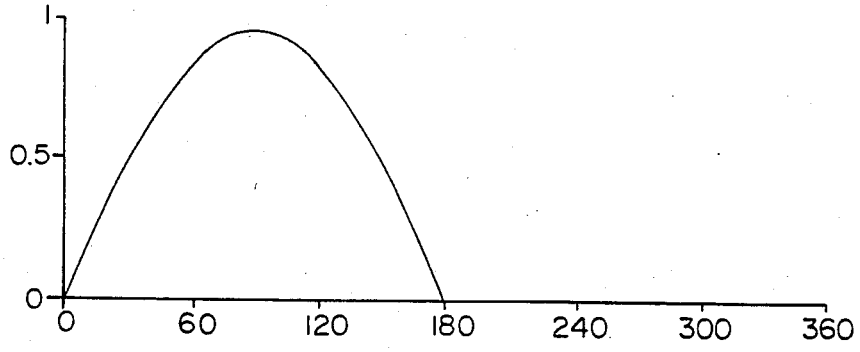
FIG. 2 is a curve to which reference will be made in describing the operation of a cyclometer register of the prior art.

Referring to FIG. 2, the torque requirements from disk 12 for moving free-counterweight disk 4 alone varies cyclically with the angular position of units cyclometer drum 34, varying from zero (neglecting friction) over the 0–180 degree range, and then varying sinusoidally from 180 to 360 degrees. If the moment of free-counterweight disk 40, referred to disk 12, is taken as unity, then the torque varies sinusoidally from zero at 180 degrees, peaks at unity at 270 degrees, and then declines sinusoidally to zero at 360 degrees. Such a torque variation imposes undesirable requirements on torque availability and is preferably reduced.

Figure 3:
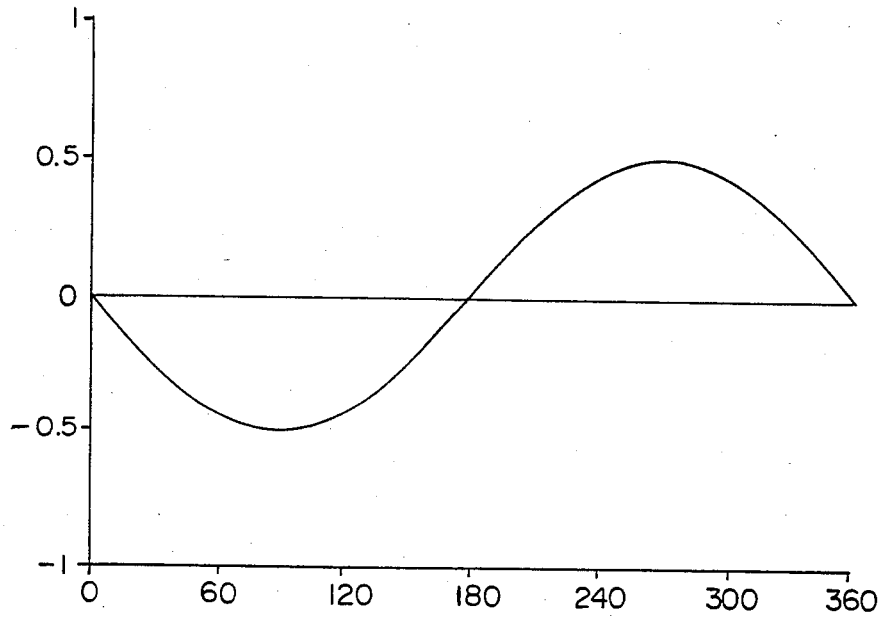
FIGS. 3–6 are curves to which reference will be made in describing the cyclometer register according to the present invention.

When proper drum counterweight 36 is added according to the teaching of the present invention, the peak torque and the torque variability, as seen at disk 12, are both reduced by half. In the preferred embodiment of the invention, the moment of drum counterweight 36 is equal to half the moment of free-counterweight disk 40, including free counterweight 44. The torque required to rotate units cyclometer drum 34, including a half-unity moment contributed by drum counterweight 36, is shown in FIG. 3. With the illustrated angular relationships, the torque required to drive units cyclometer drum 34 alone increases sinusoidally from zero at zero degrees to 0.5 at 90 degrees, decreases through zero at 180 degrees to −0.5 at 270 degrees then increases to zero at 360 (0) degrees.

Figure 4:
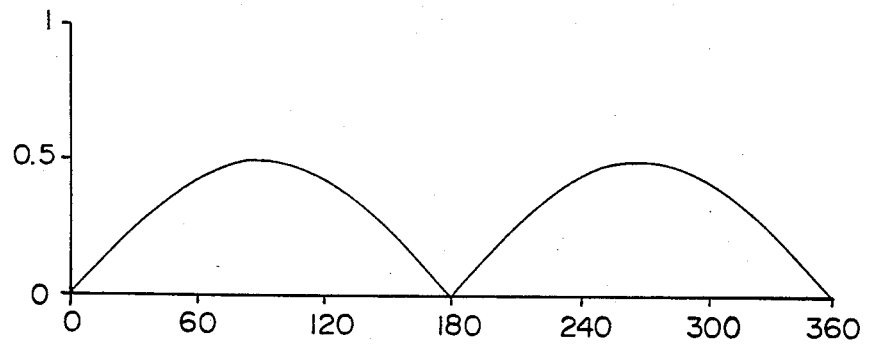

The sum of the moments of free-counterweight disk 40 and units cyclometer drum 34, including drum counterweight 36, is shown in FIG. 4. It will be noted that the negative moment of drum counterweight 36 between 180 and 360 degrees, subtracted from the positive moment of free-counterweight disk 40 over this angular range, reduces the maximum moment from unity to 0.5, as seen at disk 12. A sinusoidal half-wave varying between zero and 0.5 is seen over the angular range from zero to 180 degrees.

The significant feature of the sum of moments shown in FIG. 4 is that the peak is reduced by half and the peak-to-peak range is also reduced by half. This result is reached by the relationship between the moments of the two masses. Making the moments of the two masses equal, as appears to be suggested by the referenced British Patents, fails to achieve the torque reduction offered by the present invention.

Figure 5:
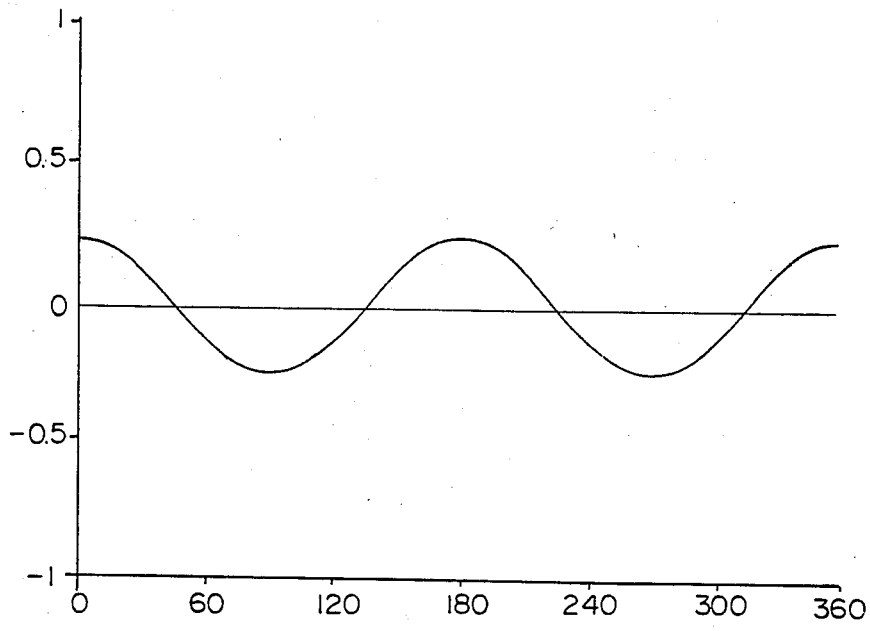

Referring again to FIG. 1, the mass of harmonic mass 26 is selected to reflect a torque requirement back to disk 12 equal to about 0.25 as great as free counterweight 44, and at an angular frequency twice that of free counterweight 44. This is accomplished using a 2:1 reduction gear ratio between intermediate pinion 24 and final pinion 28 and making the actual moment of harmonic mass 26 about its own shaft equal to 0.125 that of free counterweight 44 about its shaft. The resulting moment, as seen by disk 12, is shown in FIG. 5. It will be noted that the phase of the moment in FIG. 5 is displaced by 90 degrees from the phases of the moments in FIGS. 2–4 as the angle passes through zero.

Figure 6:
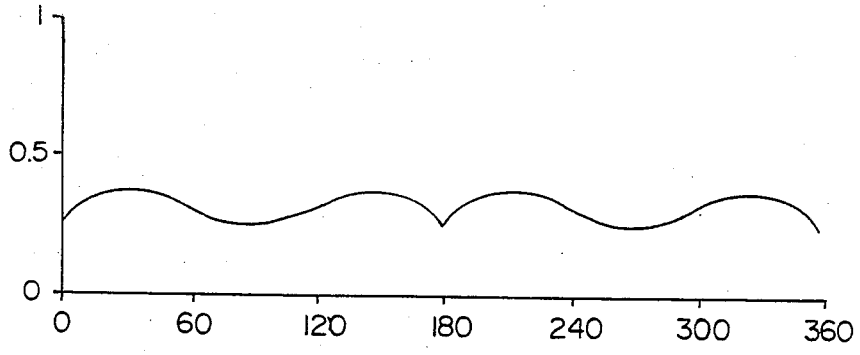
Figure 2:
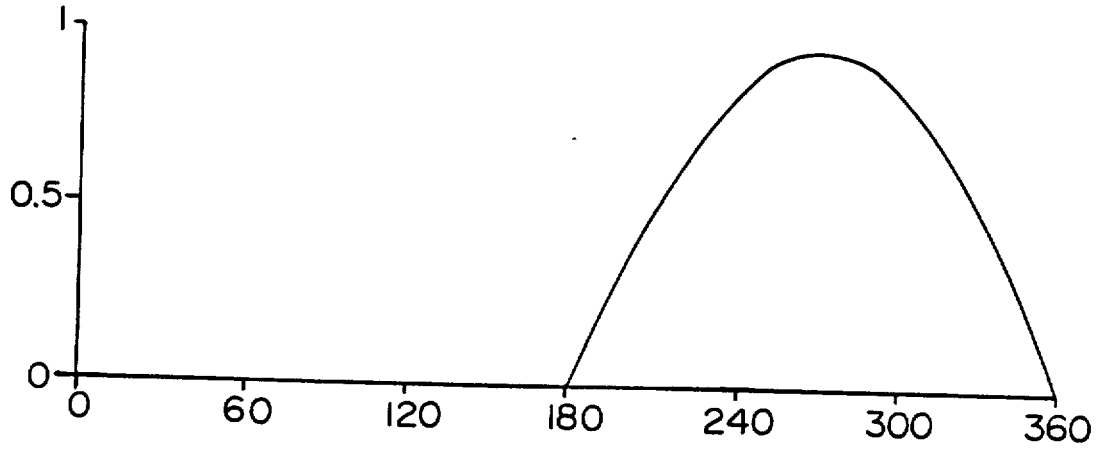
Figure 3:
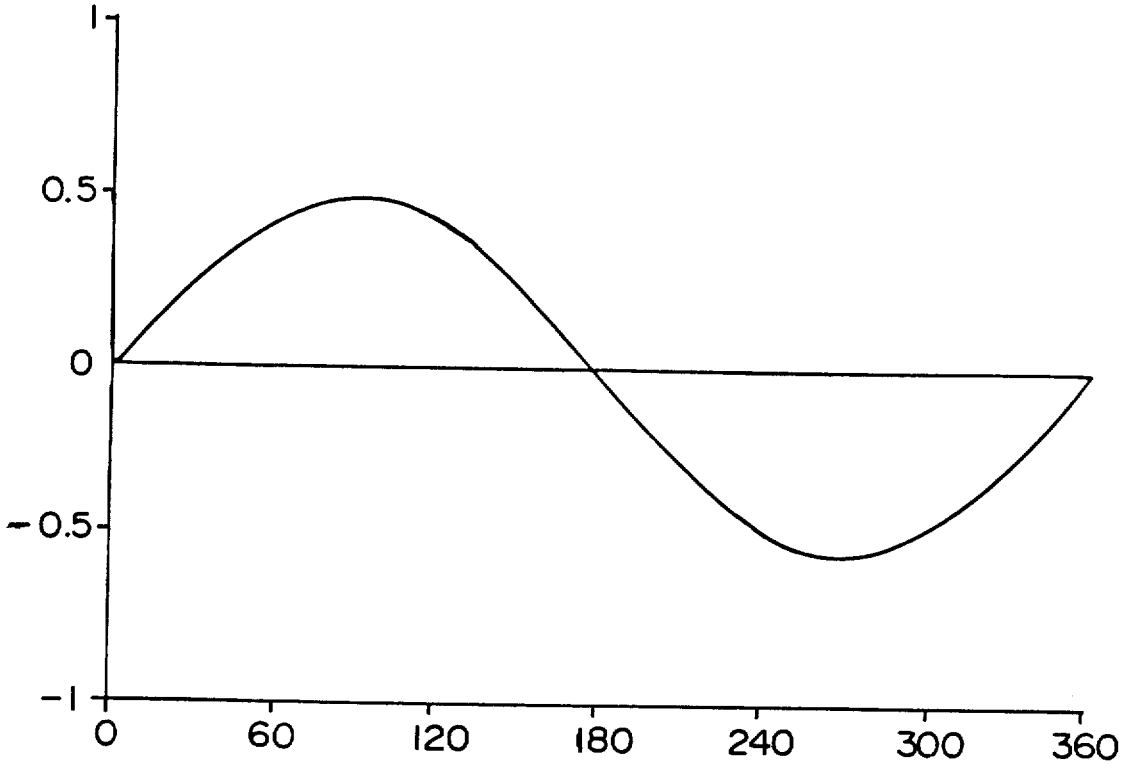

The sum of the moments, including that of harmonic mass 26, as seen from disk 12, is shown in FIG. 6. It will be noted that the peak moment is further reduced from 0.5 in FIG. 4 to about 0.38. Perhaps as importantly, the minimum moment is increased from zero to about 0.25. The range of moment variation over a cycle is thus reduced to about 0.13. It is believed that the reduced magnitude of the maximum moment as seen at disk 12 helps to reduce the frictional torque and, more importantly, the relative constancy of the moment allows offsetting by adjusting the meter for a compensating increased torque, therby contributing to reduced metering errors.

Some cyclometer registers of the prior art are used in watthour meters in which the significance of units cyclometer drum 34 is other than unity watthours. Thus, units cyclometer drum 34 should be understood as the lowest-order drum regardless of the significance attached to its indication. In addition, it is the practice in some electric meters to shield units cyclometer drum from view so that the smoothly moving indication thereon does not interfere with accurate reading of the register. The present invention contemplates registers of the type disclosed above, whether or not some or all of the cyclometer drums thereof are made available for viewing.

The above disclosure discusses a single harmonic mass 26 having one-eighth the moment about its own shaft of free-counterweight 40 about its own shaft rotating at twice the speed of units cyclometer drum 34 and angularly phased 90 degrees from the moment of units cyclometer drum 34. One skilled in the art, with the present disclosure for reference, would understand that the present invention is not limited to such an arrangement. Other harmonic masses (not shown) may be disposed on other shafts wherein the shaft gearing and harmonic masses are selected for further reducing torque variability. For example, a shaft may be geared to rotate at four times the speed of units cyclometer drum 34 and have a moment equal to one-sixteenth the moment of free-counterweight disk 40. When properly phased, such an additional harmonic mass is effective for further reducing the maxima and increasing the minima of the torque reflected back to be driven by disk 12.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cyclometer register comprising:

a lowest-order cyclometer drum smoothly rotated at a speed proportional to a quantity to be measured;

a free-counterweight disk freely disposed for rotation on a shaft concentric with said lowest-order cyclometer drum;

said free-counterweight disk having a first predetermined rotational moment;

at least one superior cyclometer drum;

means for advancing said at least one superior cyclometer drum in response to a free rotation of said free-counterweight disk;

cooperating means on said lowest-order cyclometer drum and said free-counterweight disk for rotating said free-counterweight disk from a stable equilibrium position to an overbalanced position from which it performs said free rotation;

a drum counterweight on said lowest-order cyclometer drum;

said drum counterweight being disposed to produce a second predetermined rotational moment;

said second predetermined rotational moment being at an angular position on said lowest-order cyclometer drum 180 degrees apart from an angular position of said first predetermined moment while said lowest-order cyclometer drum is rotating said free-counterweight disk; and said second predetermined rotational moment is equal to a predetermined fraction of said first predetermined rotational moment, whereby a peak torque required to rotate said free-counterweight disk is reduced.

2. A cyclometer register according to claim 1 wherein said predetermined fraction is one-half.

3. A cyclometer register according to claim 2, further comprising:

a gear driving said lowest-order cyclometer drum;

said gear rotating at a speed equal to twice a rotational speed of said lowest-order cyclometer drum;

means for producing a third predetermined rotational moment attached to said gear;

said third predetermined rotational moment being equal to about one-eighth of said first predetermined rotational moment; and said third predetermined rotational moment being angularly phased 90 degrees from a phase of said second predetermined rotational moment, whereby maximum torques are reduced and minimum torques are increased.

* * * * *

UNITED STATES PATENT AND TRADEMARK OFFICE

CERTIFICATE OF CORRECTION

PATENT NO. : 4,728,782

DATED : March 1, 1988

INVENTOR(S) : Samuel G. Hardy

It is certified that error appears in the above-identified patent and that said Letters Patent is hereby corrected as shown below:

Figures 2 and 3 should be deleted to appear as per attached Figures.

Signed and Sealed this

Twentieth Day of September, 1988

*Attest:*

*Attesting Officer*

DONALD J. QUIGG

*Commissioner of Patents and Trademarks*